United States Patent [19]

Feerick

[11] 4,015,512

[45] Apr. 5, 1977

[54] GAS-OPERATED FIREARM

[76] Inventor: Jay J. Feerick, 1847 MacArthur Blvd., Oakland, Calif. 94602

[22] Filed: Oct. 29, 1974

[21] Appl. No.: 518,639

[52] U.S. Cl. ..... 89/190; 89/192

[51] Int. Cl.[2] ..... F41D 5/04

[58] Field of Search ..... 89/192, 168, 169, 176, 89/190

[56] References Cited

UNITED STATES PATENTS

| | | | |
|---|---|---|---|
| 591,525 | 10/1897 | Burgess | 89/176 |
| 1,004,424 | 9/1911 | Hennick | 89/192 |
| 2,093,707 | 9/1937 | Browning | 89/190 |
| 2,098,727 | 11/1937 | Lahti | 89/190 |
| 2,601,808 | 7/1952 | Clarke | 89/190 |
| 2,714,334 | 8/1955 | Harvey | 89/190 |
| 2,900,878 | 8/1959 | Nomar | 89/190 |
| 3,174,401 | 3/1965 | Beretta | 89/192 |
| 3,282,165 | 11/1966 | Maillard | 89/190 |
| 3,289,535 | 12/1966 | Hupp | 89/190 |
| 3,776,096 | 12/1973 | Donovan | 89/192 |

*Primary Examiner*—Stephen C. Bentley

[57] ABSTRACT

A gas-operated firearm is disclosed in which the gas port is located in the forward part of the chamber, in the part of the barrel bore wall which surrounds the portion of the bullet projecting from the case of a chambered cartridge. In the disclosed firearm the bolt remains locked in its breech-closing position until the gas pressure resulting from the detonation of a cartridge drops to practically zero (gauge). The bolt, which rides on guide rails in the receiver, is provided with a pivotable locking member constructed and arranged to engage locking recesses in the guide rails when it is pivoted into one of its extreme positions. The locking member can be withdrawn from engagement with the locking recesses in the guide rails, and the bolt impelled rearwardly, when a lug projecting from the locking member is struck by a cam which is pivotably mounted in the receiver. An operating slide, mounted in the receiver for sliding parallel to the sliding motion of the bolt, is driven rearwardly in the receiver by the pressure of the gas resulting from the detonation of a cartridge in the chamber driving a ram from a cylinder and compressing the operating slide return springs. When the gas pressure in the cylinder, resulting from the detonation of the cartridge, has dropped to a very low level or zero (gauge) the operating slide is driven forward by the action of its return springs and the operating slide engages the operating cam, rocking it sufficiently to disengage the locking member from its associated recesses in the bolt guide rails and driving the bolt rearwardly. Extraction and ejection of the spent cartridge and cocking of the hammer and trigger mechanism takes place in the well known manner during the rearward travel of the bolt. When immediately thereafter the bolt is driven forward by its return springs a new cartridge is stripped from the magazine and chambered and the locking member is re-engaged with its cooperating locking recesses in the bolt guide rails by spring action, by the action of a depressor plunger mounted in the bolt which strikes the rear face of the barrel block as the breech is closed by the returning bolt, or both. The firing pin is held out by the locking member when the locking member is in its bolt-unlocked position, so that the arm can be fired only when the bolt is locked in its breech-closing position.

2 Claims, 15 Drawing Figures

GAS-OPERATED FIREARM

BACKGROUND OF THE INVENTION

1. Field of the Invention

The present invention relates to gas-operated firearms and more particularly to improved gas-operated firearms in which the gas port is located in the forward portion of the catridgechamber and in which the bolt is locked in its breech-closing position until the pressure of the gas generated by the detonation of a cartridge drops to a very low level or practically zero (gauge).

2. Description of the Prior Art

Gas-operated firearms are well known in the prior art. In all of the successful gas-operated firearms of which I am aware, however, the operating gas pressure is derived from a port located somewhere along the barrel beyond the mouth of the cartridge-containing chamber portion of the barrel. This conventional gas port location, i.e., along the barrel, has the advantage of providing operating gas pressures which are lower than the very high pressures initially generated in the cartridgecontaining chamber portion of the barrel bore immediately after the cartridge is detonated, but suffers from the disadvantage that a gas tube must be provided, which extends, for instance, along the underside of the barrel, adding to the weight and bulk of the arm, and the additional disadvantage of disturbance of the barrel as the bullet passes the port in the barrel. Further, the operating gas pressure derived even from a port located near the mouth of the barrel is not as low as is desirable, and the unlocking of the bolt in certain conventional gas-operated firearms of the prior art starts to take place while the bullet is still in the barrel, and the operating gas pressure is very high as compared with the ambient pressure. This premature unlocking or at least partial unlocking of the bolt during the existence of relatively high operating gas pressure sometimes leads to the jamming of said conventional gas-operated firearms by distorted cartridge cases, which are "ballooned" against the face of the retreating bolt by the remaining high-pressure operating gas.

SUMMARY OF THE INVENTION

Accordingly, it is an object of the present invention to provide a gas-operated firearm in which the gas port is located in the wall of the catridge-containing chamber portion of the barrel bore, thus eliminating the need for a gas tube extending forward from the receiver along a substantial portion or all of the barrel.

Another object of the present invention is to provide a compact gas-operated firearm in which the gas-operated mechanism is completely contained within the receiver.

Another object of the invention is to provide a mechanism for mechanically storing energy from the high pressure gases supplied by a detonating cartridge and thereafter utilizing the stored energy to operate the breech bolt and associated mechanism when gas pressure in the barrel has dropped to a comparatively low value.

Yet another object of the present invention is to provide a gas-operated firearm in which the unlocking of the bolt is delayed until after the operating gas pressure has dropped to a very low level, e.g., 50 lbs. per square inch gauge or less, thus reducing jamming and other problems of cartridge case extraction occasioned by the ballooning of spent cartridge cases due to premature unlocking or partial unlocking of the bolt while the operating gas pressure remains high.

A further object of the present invention is to provide a gas-operated firearm having delayed-action bolt-locking means which prevents the firing pin from being driven forward to detonate a cartridge while the bolt is unlocked.

Yet another object of the present invention is to provide a gas-operated firearm having delayed-action bolt-locking means which is spring-biased toward its bolt-locking position and is also provided with positive mechanical means for driving in into its bolt-locking position when the bolt returns to and closes the breech.

Other objects of the present invention will in part be obvious and will in part appear hereinafter.

The present invention accordingly comprises the features of construction, combination of elements, and arrangement of parts which will be exemplified in the construction hereinafter set forth, and the scope of the present invention will be indicated in the appended claims.

In accordance with a principal feature of the present invention a gas-operated firearm is provided in which the gas port is located in that portion of the barrel bore surrounding the portion of the bullet which projects from the case of a chambered cartridge.

In accordance with another principal feature of the present invention a gas-operated firearm is provided in which the bolt remains locked and the breech tightly closed until the gas pressure in the barrel has dropped to or near to ambient pressure.

In accordance with another feature of the present invention a gas-operated firearm is provided in which the bolt-locking means coacts with the firing pin to prevent it from being driven forward to detonate a cartridge unless the bolt is locked by said bolt-locking means.

In accordance with yet another feature of the present invention a gas-operated firearm is provided in which the gas piston drives an operating slide toward the rear of the receiver and holds it there against the action of its return springs until the gas pressure has dropped to a sufficiently low level to permit its return springs to drive it forward, whereupon, and only whereupon, the operating slide causes the bolt to be unlocked and driven open.

In accordance with a particular aspect of the present invention a gas-operated firearm comprises a barrel; receiver means defining a cartridge-receiving chamber, said chamber having an open breech; breech-closing means movable to and from a breech-closing position in which said breech-closing means closes said breech; locking means for locking said breech-closing means in said breech-closing position; and delayed unlocking means for unlocking said locking means when the gas pressure resulting from the detonation of a cartridge in said chamber drops to a predetermined level.

In accordance with a further aspect of the present invention said unlocking means is operated by said gas pressure, and said unlocking means also serves to propel said breech-closing means away from said breech-closing position.

In accordance with yet another aspect of the present invention the gas pressure for operating said unlocking means is derived from a port located at the end of said chamber nearest said barrel.

In accordance with a still further aspect of the present invention said unlocking means comprises slide means, said slide means being resiliently biased toward a normal position by bias spring means, said slide means comprises a piston, said piston being close-fittingly received in a cylinder, said cylinder being supplied by means of a conduit with gas under pressure resulting from the detonation of a cartridge in said chamber, and said unlocking means can unlock said locking means only when said piston is moving into said cylinder.

In accordance with yet another aspect of the present invention said unlocking means includes a cam pivotally mounted on a pivot journaled in said receiver, said cam having a first lobe and a second lobe, said pivot being so positioned that said slide means can strike said first lobe of said cam when said piston is moving into said cylinder, and said locking means being so positioned with respect to said pivot that when said slide strikes said first lobe and thus rotates said cam about said pivot said second lobe strikes said locking means and unlocks it.

For a fuller understanding of the nature and objects of the present invention reference should be had to the following detailed description taken in connection with the accompanying drawings.

DESCRIPTION OF THE PREFERRED EMBODIMENT

Figure 1:
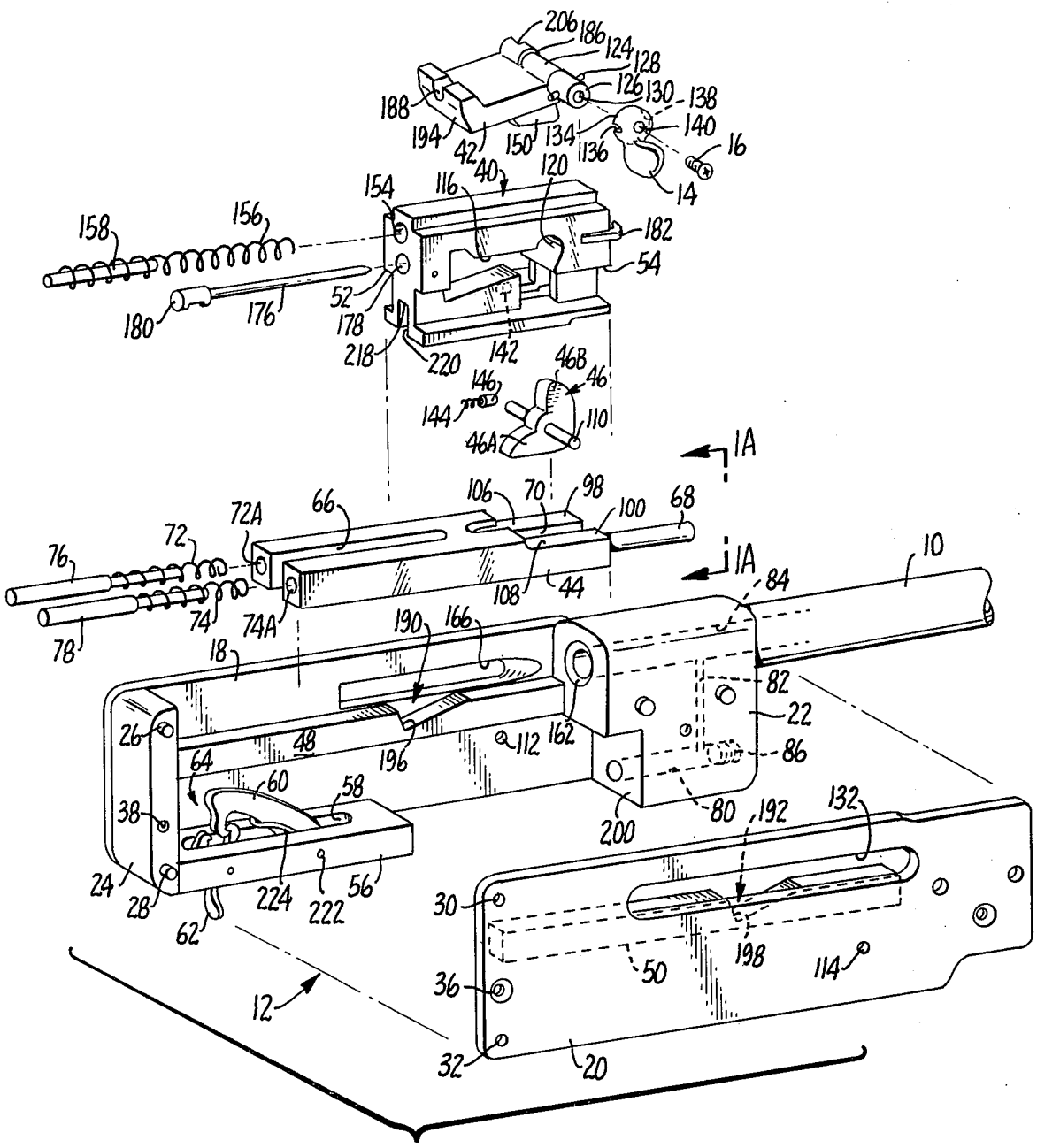
FIG. 1 is a fragmentary exploded perspective view of a gas-operated firearm constructed in accordance with a preferred embodiment of the present invention.

Referring now to FIG. 1, there are shown the principal parts of said preferred embodiment of the present invention, including the barrel 10 (shown in part only), and the receiver 12 which surrounds all of the other parts except the operating handle 14 and its retaining screw 16.

Receiver 12 is principally comprised of two side plates 18 and 20, barrel block 22, and back block 24.

When the firearm of said preferred embodiment is assembled, side plates 18, 20 are assembled to barrel block 22 and back block 24 by means of aligning pins, such as pins 26 and 28, passing through corresponding holes 30 and 32, and machine screws passing through holes such as hole 36 and engaging the threads of tapped holes such as tapped hole 38, all as will be evident to those having ordinary skill in the art from the present drawings.

The principal parts of the firearm of the preferred embodiment of the present invention mounted within receiver 12 are the bolt 40, the bolt lock, or lock, 42, the operating slide or ram element 44, and the operating cam 46.

As further seen in FIG. 1, a guide rail 48 is affixed to the inside surface of the left side plate 18 of receiver 12, and a corresponding right guide rail 50 is affixed to the inner surface of right side plate 20 of receiver 12.

When the firearm of the preferred embodiment is assembled bolt 40 is slidably mounted upon guide rails 48 and 50, the left hand longitudinal recess 52 in one side of bolt 40 engaging left hand guide rail 48, and the right hand longitudinal recess 54 of bolt 40 engaging right hand guide rail 50.

As best seen in FIG. 1, a plate 56 called the trigger plate serves as a partial closure of the bottom of receiver 12. Trigger plate 56 may be maintained in place as indicated in FIG. 1 by fastening means well known to those having ordinary skill in the art. Trigger plate 56 is provided with an opening 58 in which is mounted a suitable trigger and hammer mechanism, such as that commonly used in Browning Automatic Shotguns, including hammer 60, trigger 62, and latch and antirepeat mechanism 64.

As may be seen from FIGS. 8A through 8E, operating slide 44 is slidably disposed between the top of trigger plate 56 and the bottom of bolt 40.

Returning to FIG. 1, it will be seen that operating slide 44 is provided with a recess 66 adapted to receive and clear hammer 60, the upper end of trigger 62, and latch and antirepeat mechanism 64. Also seen in FIG. 1 is the piston 68 which is immovably affixed to operating slide 44, as by brazing or formed integrally therewith.

Figure 2:
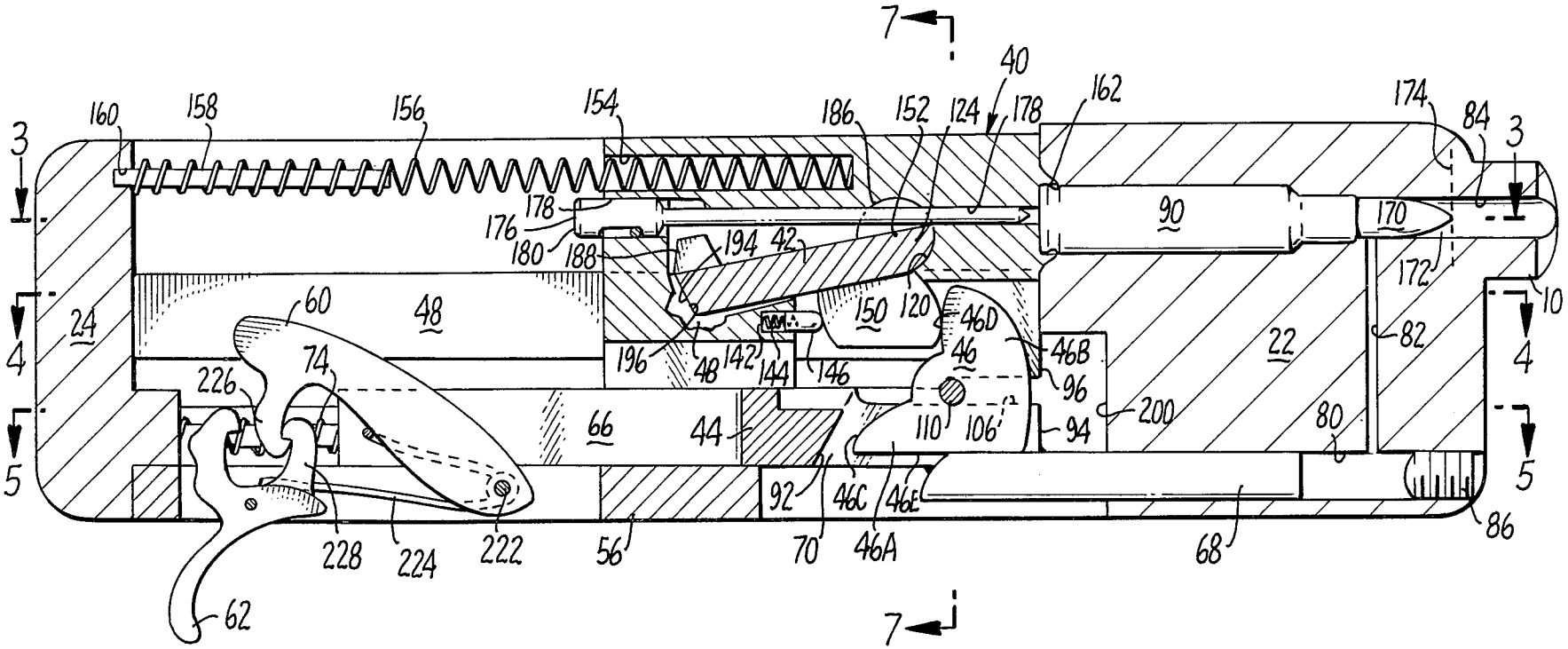
FIG. 2 is a fragmentary vertical sectional view of the preferred embodiment of the present invention shown in FIG. 1 as assembled.

As will best be seen in FIG. 2, operating slide 44 is provided with a recess 70 adapted to receive the first lobe 46A of operating cam 46.

Returning again to FIG. 1, it will be seen that operating slide 44 is provided with return spring means, here consisting of a pair of return springs 72, 74, each spring embracing an associated operating slide return spring guide stud 76, 78. Operating slide 44 is provided with two bores 72A, 74A extending longitudinally to accommodate operating springs 72 and 74 and their associated spring guides 76, 78. A pair of holes (not shown) are provided on the inside of back block 24 to receive the outer ends of operating slide return spring guides 76, 78.

As may be seen in FIG. 2, piston 68 of operating slide 44 is slidably and close-fittingly engaged with cylinder bore 80 of barrel block 22.

Thus, from the description immediately above, it may be seen that when the firearm of the preferred embodiment is assembled operating slide 44 is slidably disposed within receiver 12 overlying trigger plate 56 and in sliding contact with the bottom face of bolt 40, and is spring-biased into a "normal" position, as seen in FIG. 2 by means of operating side return springs 72, 74.

As may also be seen in FIG. 2, the interior of gas piston 80 is in communication with bore 84 of barrel 10 by way of gas conduit 82, and the inner end of gas cylinder 80 is blocked by tight-fitting threaded plug 86. Thus, it may be seen from FIG. 2 that operating gas under pressure generated in bore 84 by the detonation of cartridge 90 therein will be conveyed to gas cylinder 80 by way of gas conduit 82 and thus will drive piston 68 out of gas cylinder 80 and drive operating slide 44 toward the rear of receiver 12, compressing operating springs 72, 74.

Continuing with the principal description of operating slide 44, which is a characteristic feature of the present invention, it will be seen in FIG. 2 that the inner end of recess 70 is shaped to provide a cam surface 92 which is adapted to coact with first lobe 46A of operating cam 46, and particularly with the outer surface 46C of first lobe 46A, all as hereinafter described.

It is particularly noted that operating slide 44 and bolt 40 are shown in FIG. 2, and also in FIG. 8A, in their normal or "quiescent" state or position, in which the front face 94 of operating slide 44 and the front face 96 of bolt 40 lie in substantially the same plane. It is to be understood that the terms "normal state", "normal position", "quiescent state", and "quiescent position" as used hereinafter in connection with operating slide 44 and bolt 40, are to be understood to be defined as set out immediately hereinabove.

It is to be further understood that the immediately above-described coplanar alignment of front faces 94, 96 when bolt 40 and operating slide 44 are in their normal or quiescent position is characteristic of said preferred embodiment only and is not a necessary feature of the present invention.

Figure 1A:
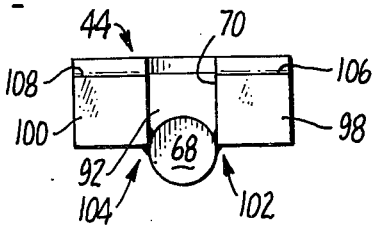
FIG. 1A is a front view of the operating slide of the invention.

The structural interrelationship of operating slide 44 and gas piston 68 is paticularly shown in FIG. 1A, which is a front view of operating slide 44. As best seen in FIG. 1A the two portruding arms 98, 100 of operating slide 44 which define recess 70 are relieved at their lower, inner edges 102, 104 to receive gas piston 68, which may be affixed in reliefs 102, 104, e.g., by brazing. It is to be understood, however, that operating slide 44 and gas piston 68 may be integrally formed in certain embodiments of the present invention.

Referring now to FIG. 1, it will be seen that the upper face of operating slide 44 is cut away at its right hand end, providing arms 98 and 100 with depressed faces 106 and 108. Going to FIG. 2, it will be understood that the forward arms 98, 100 are thus cut back, providing depressed faces 106, 108, in order to accommodate pivot pin 110 of operating cam 46, which extends between side plates 18 and 20 and is journaled in close-fitting holes 112, 114 in side plates 18, 20 respectively.

Turning now to consideration of bolt 40, of which certain structural aspects now to be described are characteristic features of the present invention, and particularly to the perspective showing thereof in FIG. 1, it will be seen that bolt 40 is provided with an opening 116 which extends therethrough from side to side.

Going to FIG. 2 it will be seen that lock 42 is located in opening 116 when the firearm of the invention is assembled, and therefore opening 116 will hereinafter sometimes be called the lock chamber.

A particular structural feature of lock chamber 116 is the parti-cylindrical portion 120 of its wall. This parti-cylindrical portion 120 of the wall of lock chamber 116 will sometimes hereinafter be called the pivot bore.

As best seen at the top of FIG. 1, lock 42 is provided at its upper, forward end with a parti-cylindrical projection or ear 124. In the fabrication of the firearm of the preferred embodiment the diameter of the parti-cylindrical surface of pivot ear 124 is so dimensioned as to be close-fittingly received in pivot bore 120 when lock 42 is mounted in lock chamber 116, as may be seen from FIG. 2.

As will also be seen from FIG. 2, the angular extent of the parti-cylindrical surface of pivot ear 124 is greater than the angular extent of the parti-cylindrical surface of pivot bore 120, and thus lock 42 is enabled to pivot about the common axis of the parti-cylindrical faces of pivot ear 124 and pivot bore 120 through a limited angle, i.e., from the position shown in FIG. 8A to the position shown in FIG. 8E, when pivot ear 124 is received in pivot bore 120.

Going to the upper portion of FIG. 1, it will be seen that lock 42 is provided with a rightwardly-extending boss 126, which is integral with lock 42 in the preferred embodiment. As also there seen, a cross-pin 128 passes substantially diametrically through lock boss 126 and is affixed therein so that it projects from both sides thereof. Additionally, lock boss 126 is provided with an axial tapped hole 130. As a final stage of assembly of the firearm of the preferred embodiment, when lock boss 126 projects through port 132 in right hand side plate 20, an internal bore (not shown) of operating handle body 134 is passed over the projecting portion of lock boss 126 until the notches 136 and 138 in the bottom flat face of operating handle body 134 engage the projecting portions of cross-pin 128. Operating handle retaining screw 16 is then passed through hole 140 in operating handle body 134 and tightened into the threads in tapped hole 130 of lock boss 126, whereby operating handle 14 is irrotatably fixed to lock boss 126 for conjoint rotation therewith at all times.

From the above it will be seen that lock 42 may be manipulated from its "locked" position (FIG. 8A) to its "unlocked" position (FIG. 8E) by drawing operating handle 14 toward the rear of the firearm of the invention and thus rocking lock 42 about the common axis of pivot ear 124 and pivot bore 120.

While lock 42 might be rocked in the opposite direction, viz., from the position of FIG. 8E to the position of FIG. 8A, by means of operating handle 14, this opposite angular or rocking motion is normally accomplished in the firearm of the preferred embodiment by the lock restoring spring assembly which will now be described.

As shown in FIGS. 1 and 2, a small bore 142 is provided in bolt 40 extending outwardly from the periphery of lock chamber 116.

As best seen in FIG. 2, a coil spring 144 is disposed in bore 142, surmounted by a plunger 146.

As seen in FIGS. 1 and 2, lock 42 is provided with an integral ear 150.

Going to FIG. 2, it will be seen that plunger 146 is resiliently pressed against ear 150 of lock 42 by coil spring 144, and that lock 42 is thus resiliently biased to rotate about common axis 152 into its locked position (FIG. 8A) by coil spring 144, plunger 146, etc.

Going to FIG. 1, it will be seen that bolt 40 is provided in its upper, rear portion with a bore 154 adapted to receive bolt driving spring 156. Contained within bolt driving spring 156 is bolt driving spring guide rod 158. As seen in FIG. 2, the rearward ends of bolt driving spring 156 and bolt driving spring guide rod 158 are received in a cavity 160 in back block 24. Thus, it will be seen that bolt driving spring 156 is provided to strongly bias bolt 40 forwardly in receiver 112 into its normal position shown in FIG. 2 wherein it closes breech 162 of barrel bore 84 substantially gas-tightly.

As will now be evident to those having ordinary skill in the art from the above description and the accompanying figures of the drawings, bolt 40 may be unlocked and drawn to its rearmost position by manually drawing operating handle 14 (FIG. 1) toward the rear of receiver 12. Initially, this rearward drawing of operating handle 14 will result in rocking lock 42 from its locked position (FIG. 8A) to its unlocked position (FIG. 8E), whereafter bolt 40 can be drawn to the full extent of its possible rearward travel against the urging of bolt driving spring 156 by continuing to manually draw operating handle 14 rearwardly.

It will also be evident to those having ordinary skill in the art from the above description, taken with the figures of the drawings referred to, that releasing operating handle 14 in its rearwardmost position will first result in bolt 40 being driven forward to its normal or breech-closing position under the urging of bolt driving spring 156, and then will result in the rocking of lock 42 into its locked position as shown in FIG. 2 under the urging of coil spring 144 through the intermediary of plunger 146.

Figure 7:
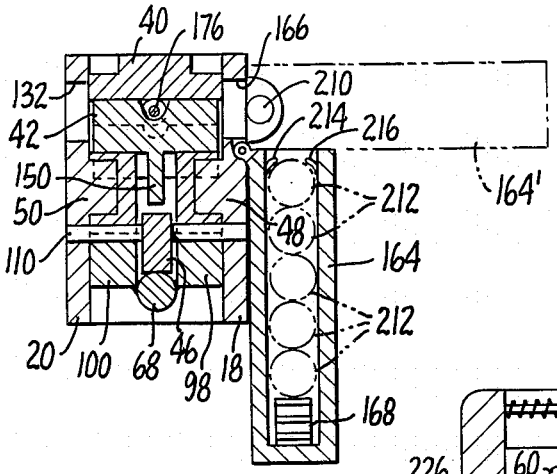
FIG. 7 is a vertical sectional view of said preferred embodiment of the present invention, taken on line 7—7 of FIG. 2.
Figure 8:
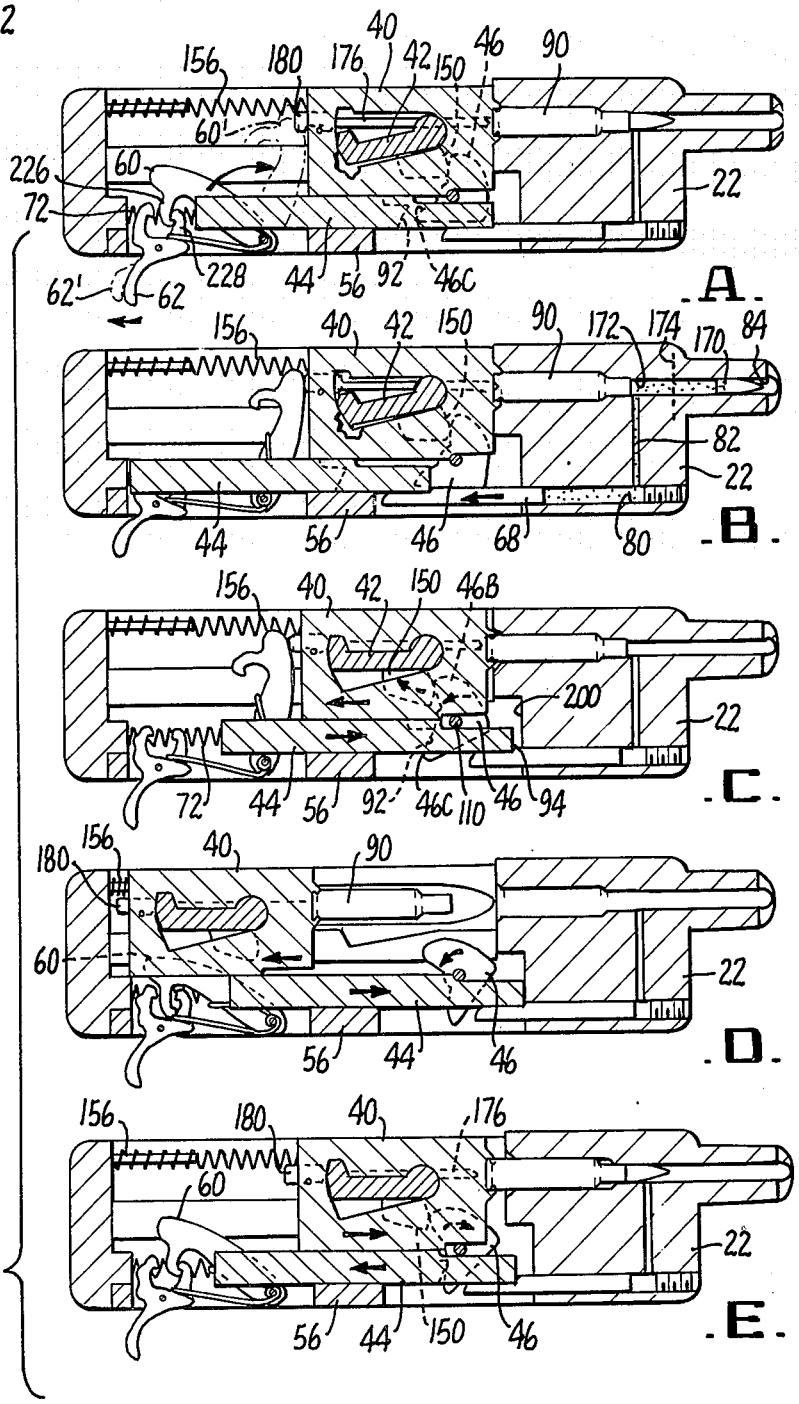
FIGS. 8A through 8E are vertical sectional views of said preferred embodiment of the present invention showing the relative disposition of certain principal ones of its parts at different stages of an operating cycle thereof.

Going to FIG. 7, it will be seen that the firearm of the preferred embodiment is provided with a folding magazine 164 which in its raised position 164' feeds cartridges through feed port 166 in left side plate 18 under the urging of a conventional cartridge feed spring 168. When the last cartridge in a magazine has been fired and there is no cartridge in the cartridge-receiving chamber magazine 164 may be reloaded in its "folded down" position and then latched in its horizontal 164' position, whereafter a cartridge may be chambered by manually drawing operating handle 14 to its extreme rear position and releasing it. Bolt 40 in its forward travel under the urging of bolt driving spring 156 will in the usual manner strip a cartridge from magazine 164 and drive it forward into that portion of bore 84 which is located between breech 162 and a plane perpendicular to the axis of cartridge 90 and tangent to the tip of bullet 170. Said portion of bore 84 will hereinafter sometimes be called the chamber, and will be identified by the reference numeral 172. Said plane tangent to the tip of bullet 170 is shown in FIG. 2 for clarity of definition and there identified by the reference numeral 174. Whenever the expressions "chamber" or "cartridge-receiving chamber" or the like are used herein it is to be understood that these expressions denote chamber 172 shown in FIG. 2, extending from breech 162 to plane 174 perpendicular to the axis of cartridge 90 and tangent to the tip of bullet 170. In the operation of the firearm of the preferred embodiment bullet 170 is fired by a firing pin 176 which detonates the charge in the cartridge case of cartridge 90 in the usual manner. Firing pin 176 is maintained in a bore 178 which extends through bolt 40. Bore 178 has a portion of smaller diameter which receives the forward end of firing pin 176 adjacent cartridge 90 and has a rearward portion of larger diameter which receives the anvil or head 180 of firing pin 176. Firing pin 176 is retained in bore 178 by retaining means of the kind well known to those having ordinary skill in the firearms art.

When trigger 62 (FIG. 2) is pulled toward the rear of receiver 12 hammer 60 is unlatched. Hammer 60 then rotates about its pivot under the urging of its associated spring in the well known manner and strikes anvil 180, thus driving firing pin 176 forward to detonate cartridge 90. As will be evident to those having ordinary skill in the art the retaining means for retaining firing pin 176 in bore 178 includes spring means for normally biasing firing pin 176 rearwardly so that the forward end of firing pin 176 normally lies within bolt 40.

In FIG. 1 there is shown a principal structural feature of the preferred embodiment. This principal structural feature of the preferred embodiment resides in the two notches 186, 188 in the top of bolt lock 42.

As may be understood from FIG. 2, notch 188 is clear of firing pin 176 when bolt lock 42 is in its lowermost or locked position.

Comparing FIG. 2 with FIG. 8E, it will further be seen that when firing pin 176 is in its retracted, or non-firing position and lock 42 is in its uppermost or unlocked position then the two projecting portions of lock 42 which define notch 188 prevent firing pin 176 from traveling forward into its cartridge-detonating position, because notch 188 is narrower than the diameter of the anvil or head 180 of firing pin 176.

Thus there is provided a principal feature of the present invention, viz., that driving pin 176 cannot move forward to detonate cartridge 90 when bolt 40 is in its unlocked position.

Referring to FIG. 1, there will now be described a principal feature of the preferred embodiment of the present invention, viz., the mode of locking and unlocking bolt 40.

As hitherto described, lock 42 is in its locked position when it is disposed as shown in FIGS. 2 and 8A.

As also hitherto descried herein, lock 42 is in its unlocked position when disposed as shown for example in FIG. 8E. The terms locked and unlocked as used hereinabove will now be explained with reference to FIG. 1.

Going to FIG. 1, it will be seen that lock 42 is considerably wider than the maximum width of bolt 40. In fact, the main body portion of lock 42, exclusive of boss 126, is almost as wide as back block 24, i.e., almost equal in width to the distance between receiver side plates 18 and 20. Put differently, the main body portion of lock 42 extends out of lock chamber 116 on both sides of bolt 40, almost to receiver side plates 18 and 20.

Thus, when bolt 40 is completely forward in its normal or breech-closing position as shown in FIGS. 2 and 8A and lock 42 is maintained in its locked position by the action of spring 144 the outer portions of the rearward end of lock 144 are received in locking recess 190 in guide rail 48 and in locking recess 192 in guide rail 50.

That is to say, when lock 42 is in its locked position its rearward surface 194 (FIG. 1) bears against wall 196 of locking recess 190 in the top of bolt guide rail 48 and also bears against rear wall 198 of locking recess 192 in the top of bolt guide rail 50.

Thus, it will be seen from the above that the expression lock as set in quotation marks hereinabove refers to that condition of the firearm of the preferred embodiment in which the rearward portion of lock 142 is engaged in locking recesses 190 and 192, so that the rear face 194 of lock 42 bears against both rear wall 196 of locking recess 190 and rear wall 198 of locking recess 192.

The expression unlocked as set in quotation marks hereinabove denotes that state of operation of the firearm of the preferred embodiment in which bolt lock 42 is in its uppermost position, such that rear face 194 of bolt lock 42 is above and completely clear of both rear wall 196 of locking recess 190 and rear wall 198 of locking recess 192, and so that bolt 40 is permitted to travel towards the rear of receiver 12 against the urging of its driving spring 156. Referring to the above description of manual unlocking of the firearm of the preferred embodiment, it will now be seen that when operating handle 14 is initially drawn toward the rear of the firearm and lock 42 is rocked into its uppermost position the rear face 194 of bolt lock 42 clears locking surfaces 196 and 198 and thus further manual drawing of the operating handle toward the rear of the firearm can impel bolt 40 toward the rear of the firearm.

The gas-operated unlocking of bolt 40 will be described hereinafter when the operation of the firearm of the preferred embodiment as a whole is considered.

It will, of course, be evident to those having ordinary skill in the art that hammer 60 is recocked each time bolt 40 is drawn to its rearmost position whether manually or by gas operation as described hereinafter.

Before describing the gas-operated action of the firearm of the preferred embodiment, the relation of operating cam 46, which is a principal feature of the preferred embodiment, to the other characteristic parts of the preferred embodiment will be considered.

As noted hereinabove, operating cam 46 is pivotally mounted in receiver 12 by means of pivot pin 110, both ends of which are journaled in suitable close-fitting cavities 112, 114 in side plates 18, 20.

Going to FIG. 2, it will be seen that when bolt 40 is in its normal or forwardmost position, closing breech 162, the integral downwardly depending ear 150 of lock 42 is closely juxtaposed to rear surface 46D of upper lobe 46B of operating cam 46, or in contact therewith.

At the same time, i.e., in the state of operation shown in FIG. 2, cam surface 92 of operating slide 44 is located slightly behind operating face 46C of lower lobe 46A of operating cam 46.

As will also be seen in FIG. 2, the distance between the forward face 94 of operating slide 44 and its opposed surface 200 of barrel block 22 is considerably greater than the distance between cam face 92 of operating slide 44 and face 46C of operating cam 46. In addition, the distance from the forward face of gas piston 68 to the lower port of gas conduit 82 is also considerably greater than the distance between cam face 92 of operating slide 44 and face 46C of lower lobe 46A of operating cam 46.

From this it can be seen that operating slide 44 is capable of moving forward beyond its normal position as shown in FIG. 2 sufficiently to strike lobe 46A of operating cam 46 and rotate operating cam 46 about its pivot 110. When operating cam 46 is thus rotated about its pivot 110 upper lobe 46B of operating cam 46 presses against lug 150 of lock 42, thus rotating lock 42 about common axis 152 until its rear face 194 clears recesses 196 and 198, and then driving bolt 40 rearwardly against the urging of its driving spring 156.

Further, before describing the operation of the firearm of the preferred embodiment, it should be understood that in accordance with another feature of the preferred embodiment the locking force for locking bolt 40 and gas-tightly sealing it against the rear face of barrel block 22 is exerted across the abutting faces of pivot ear 124 and pivot bore 120, at one end of lock 42, and across face 194 and faces 196 and 198, at the other end of lock 42. In other words, the use of mating pivot ear 124 and pivot bore 120 instead of a more conventional form of pivot results in a "jamming" action whereby each time the firearm of the preferred embodiment is locked lock 42 is "jammed" between cylindrical surface 120 within bolt 40 and locking surfaces 196 and 198 of the locking recesses 190 and 192, which themselves constitute part of receiver 12.

Figure 6:
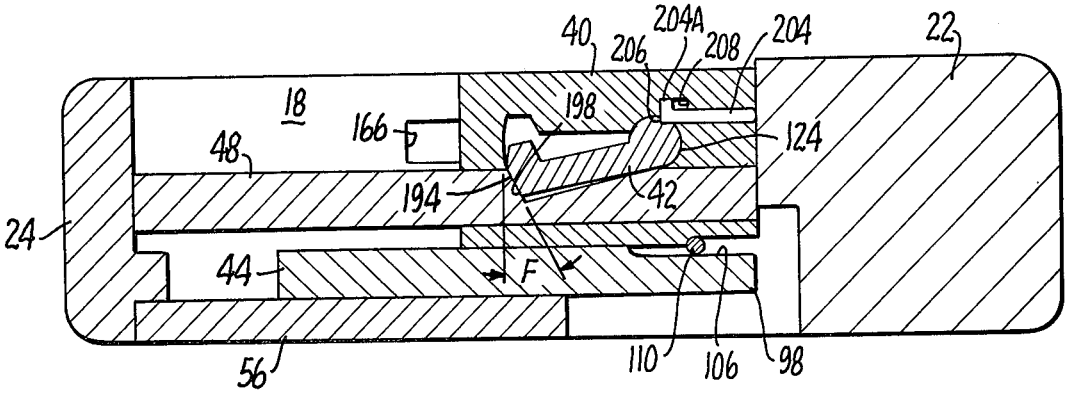
FIG. 6 is a vertical sectional view of said preferred embodiment of the present invention, taken on line 6—6 of FIG. 3.

For optimum operation of the firearm of the preferred embodiment, then, it will be evident that the angle between the planes of locking faces 196 and 198 and the normal to the tops of their respective guide rails 48 and 50, viz., small angle F, FIG. 6, must be properly selected. A suitable value of this angle for the carrying out of the present invention by way of the configuration of said preferred embodiment is approximately 16 degrees.

Figure 3:
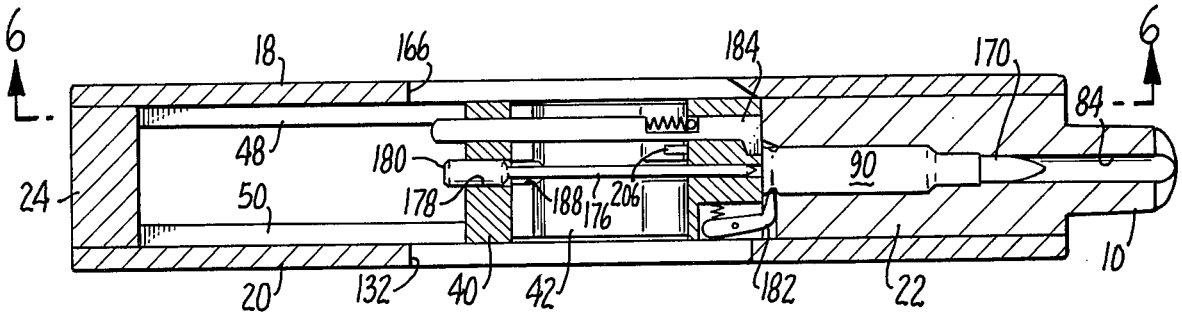
FIG. 3 is a plan view in section of said preferred embodiment of the present invention, taken on line 3—3 of FIG. 2.
Figure 4:
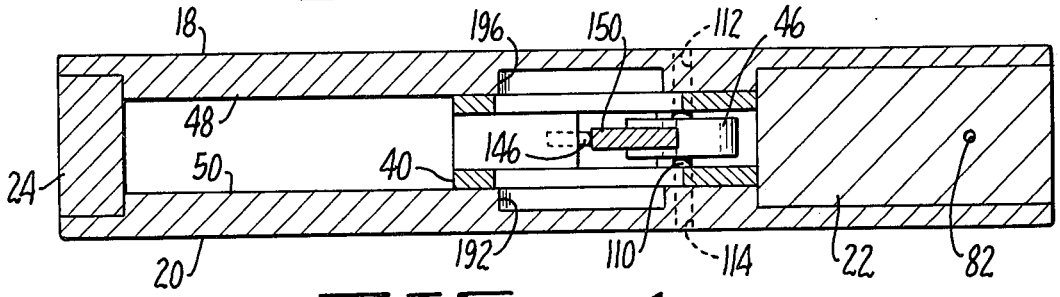
FIG. 4 is a plan view in section of said preferred embodiment of the present invention, taken on line 4—4 of FIG. 2.
Figure 5:
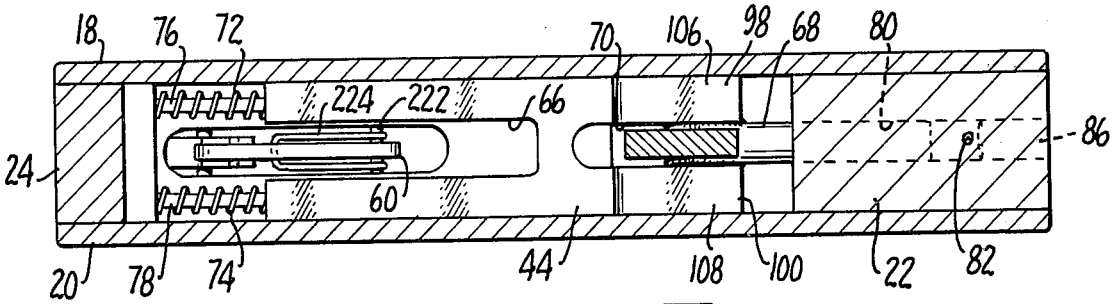
FIG. 5 is a plan view in section of said preferred embodiment of the present invention, taken on line 5—5 of FIG. 2.

As shown in FIG. 3, extractor 182 and ejector 184 are of conventional form. Thus, extractor 182 and ejector 184 will not further be desribed herein.

Going to FIG. 6, there is shown a further structural feature of the present invention whereby lock 42 is positively locked, even in the event that spring 144 becomes jammed or otherwise inoperative.

As may be seen in FIG. 6, a plunger member, herein called the depressor and referred to by reference numeral 204, coacts with a notch 206 in pivot ear 124 of lock 42 and passes through a suitable channel 208 in bolt 40.

When bolt 40 is tightly closed against the breech end of barrel block 22 the forward end of depressor 204 bears against barrel block 22 and its rear end is thrust into notch 206, thereby holding lock 42 in its locked position. The small upstandng end portion 204A of depressor 204 serves to maintain it within channel 208 and as may be seen in FIG. 6 channel 208 provides sufficient clearance for end portion 204A to allow depressor 204 to be moved forward until one of its ends projects slightly out of bolt 40 when bolt 40 is withdrawn from barrel block 22.

As will also be seen from FIG. 6, angle F is so selected that as lock 42 is rotated upward toward its unlocked position face 194 retreats incrementally from locking faces 196 and 198, whereby depressor 204 is allowed to project incrementally from the forward face of bolt 40, and thus upward rocking of lock 42 from its locked to its unlocked position is permitted.

OPERATION

Assuming that the chamber 172 (FIG. 2) of the firearm of the preferred embodiment is empty and that there are no cartridges in magazine 164 (FIG. 7) the process of loading the firearm of the preferred embodiment will now be described.

Further assuming magazine 164 (FIG. 7) to be in its "horizontal" position 164' the user of the firearm first grasps the outer end of magazine 164 and thrusts it downward and inward, disengaging it from magazine latch 210 and positioning it in the solid-line or "vertical" position 164 as seen in FIG. 7.

With empty magazine 164 in the vertical position the user of the firearm of the preferred embodiment loads magazine 164 with a plurality of cartridges 212 in the usual manner, i.e., thrusting the rear end of each successive cartridge downward against a previous cartridge or the cartridge feed plate until the cartridge being loaded clears the conventional ears 214, 216, whereafter the user thrusts the cartridge to the rear under ears 214, 216 until it seats and then feeds the next cartridge 212, etc.

After magazine 164, being in the vertical position, is thus completely loaded with cartridges 212, the user grasps the lower end of magazine 164 and pushes it upward and outward until the magazine assumes the horizontal position 164' (FIG. 7) where it is held by magazine latch 210, which is conventional, forms no part of the present invention, and will not be described here.

With loaded magazine 164 in its horizontal position the user of the firearm of the present embodiment then grasps operating handle 14 (FIG. 1) and pulls it toward the rear of the firearm.

As explained hereinabove, the initial portion of the rearward stroke of operating handle 14 results in rocking bolt lock 42 from its locked position (FIG. 8A) to its unlocked position (FIG. 8E). As also explained hereinabove, rocking bolt lock 42 from its locked position to its unlocked position disengages rear face 194 of bolt lock 42 from locking faces 196 and 198 of locking recesses 190 and 192 in bolt guide rails 48 and 50, which are affixed to the side plates 18 and 20 of receiver 12.

When operating handle 14 has thus been drawn sufficiently rearwardly to rock bolt lock 42 far enough to raise rear face 194 of bolt lock 42 above the tops of guide rails 48 and 50, i.e., completely out of locking recesses 190 and 192, bolt 40 can be drawn rearwardly to substantially the extent of its maximum rearward travel as the user further draws operating handle 14 to the rear of the firearm.

Assuming that the hammer and trigger mechanism 60, 62, 64 is not already cocked, the rearwardly moving bolt 40, and particularly the bottom 218 of recess 220 (FIG. 1), forces hammer 60 to pivot about its axis 222 (FIG. 2), against the urging of its associated spring 224 (FIG. 2) until its latch arm 226 engages with latch arm 228 of the trigger mechanism. The firearm of the preferred embodiment is then cocked, and hammer 60 will fly upward and forward to strike anvil 180 of firing pin 176 whenever bolt 40 is in its normal position and trigger 62 is pulled to unlatch hammer 60.

After bolt 40 has been drawn to its rearmost position by the user of the firearm of the preferred embodiment pulling operating handle 14 rearwardly, the user releases operating handle 14 and bolt 40 flies forward under the urging of its driving spring 156.

During the forward travel of bolt 40 a cartridge is stripped from magazine 164, and chambered, in the manner which is old and well known and will not be described here.

Assuming now that the firearm of the preferred embodiment has been loaded as described immediately above, a full semiautomatic firing cycle of the firearm of the preferred embodiment will now be described, referring successively to FIGS. 8A through 8E.

Going now to FIG. 8A and comparing it with FIG. 2 it will be seen that FIG. 8A is an abbreviated, schematized version of the structure shown in FIG. 2, schematically representing the principal parts of the firearm of the preferred embodiment in their normal or quiescent state.

When, with the firearm of the preferred embodiment in this normal or quiescent state, trigger 62 is pulled to its 62' position latch 228 escapes latch arm 226 of hammer 60 and hammer 60 flies forward to its 60' position, striking anvil 180 of firing pin 176 and driving firing pin 176 forward to detonate chambered cartridge 90.

Going to FIG. 8B, which shows the disposition of the parts of the firearm of the preferred embodiment immediately after detonation of cartridge 90, it will be seen that at this time bullet 170 has moved but slightly forward into barrel bore 84.

At this early stage the operating gas generated by the detonation of cartridge 90 at very high initial pressure, e.g., 50,000 lbs. per square inch, has already traveled to cylinder bore 80 by way of a gas conduit 84, and has driven piston 68 rearwardly to its maximum possible extent, i.e., so far that operating slide 44 is driven to its rearwardmost position.

In the mode of firearm operation characteristic of the present invention operating cam 46 remains in the same angular position which it occupied in the quiescent state though operating slide 44 has been driven to its rearwardmost position by piston 68.

In accordance with another characteristic feature of the present invention bolt lock 42 also remains in its locked position though operating slide 44 has been driven by gas operation to its rearwardmost position in the firearm; that is to say, rear face 194 of lock 42 remains engaged with locking faces 196 and 198 of locking recesses 190 and 192 (FIG. 1) at the phase of the semi-automatic operating cycle of the firearm of the preferred embodiment shown in FIG. 8B.

In accordance with a further characteristic feature of the present invention operating slide return springs 72, 74 (FIG. 1) are selected to be of such strength that the pressure of the operating gas in cylinder bore 80 maintains operating slide 44 in its rearwardmost position until bullet 170 has left barrel bore 84 and the pressure in chamber 172 has dropped to a very low value, e.g., somewhere between 0 and 50 lbs. per square inch gauge.

Going to FIG. 8C, it will be seen that the operating gas pressure has substantially dissipated, and that operating slide 44 has traveled almost completely forward under the urging of its return springs 72, 74 (FIG. 1).

It is to be particularly noted that operating slide 44 in moving forward under the urging of its just previously compressed return springs 72, 74 moves beyond its normal position (as shown in FIG. 8A) and continues forward until its front face 94 strikes the opposed face 200 of barrel block 22.

This overtravel or overshooting of operating slide 44 is permitted by the fact that operating slide 44 is not affixed to its return springs 72, 74. Return springs 72, 74 are, in fact, preferably of such length that when operating slide 44 is in its normal position (FIG. 8A) they can "rattle" or move a slight distance into and out of the bores 72A and 74A in the rear of operating slide 44 which receive and guide them.

Returning to FIG. 8C and comparing it with FIG. 8A it will be seen that slightly after operating slide 44 passed through its normal position (FIG. 8A) on the way forward its cam face 92 struck face 46C of lower lobe 46A of operating cam 46, rocking operating cam 46 about its pivot 110 and thus causing upper lobe 46B of operating cam 46 to strike integral ear 150 of lock 42, and rotate lock 42 into its unlocked position.

It is to be particularly noted that in accordance with a principal characteristic feature of the preferred embodiment of the present invention bolt 40, lock 42, ear 150, and operating cam 46 are so constructed and arranged that the rocking of operating cam 46 by overshooting operating slide 44 not only unlocks bolt 40, i.e., rocks lock 42 to its unlocked position, but also forceably drives bolt 40 toward the rear of receiver 12 via the contact between upper lobe 46B of operating cam 46 and ear 150, and, indeed, drives bolt 40 to the maximum extent of its rearward travel, as shown in FIG. 8D.

As bolt 40 is driven rearwardly the spent case of cartridge 90 is extracted by the conventional extractor shown in FIG. 3, and when bolt 40 nears its maximum rearward position the conventional ejector 184 shown in FIG. 3 ejects the spent case of cartridge 90 through ejection port 132 in right hand side plate 20 (FIG. 1).

After being driven to its maximum rearward position (FIG. 8D) by impulse provided by operating slide 44 via operating cam 46 and ear 150, bolt 40 is driven forward by its driving spring 156, stripping a new cartridge from magazine 154 and chambering that cartridge in the well known manner (FIG. 8E).

As may also be understood from FIG. 8E, ear 150 strikes the upper lobe of operating cam 46 and rocks it in a clockwise direction toward it normal position (FIG. 8A) during the latter part of the forward travel of bolt 40. When cam 46 is thus rocked, lobe 46A strikes surface 92 of operating slide 44, driving operating slide 44 to its normal or quiescent position (FIGS. 2 and 8A).

Finally, the normal condition of operation of the firearm of the preferred embodiment as shown in FIG. 8A is completely restored when with bolt 40 in its forwardmost or normal position spring 144 (FIGS. 1 and 2) urges lock 42 in a counterclockwise direction, pressing the rearward end of lock 42 into locking recesses 190 and 192 (FIG. 1).

As described hereinabove in connection with FIG. 6, depressor 204 may aid the action of spring 144 in seating the rearward end of lock 42 in locking recesses 190 and 192, and may, in the event that spring 144 becomes broken, jammed or otherwise inoperative, serve by itself to positively seat lock 42.

It will be understood by those having ordinary skill in the art, as informed by the present disclosure, that hammer 60 is cocked during the rearward travel of bolt 40.

ALTERNATIVE PREFERRED EMBODIMENT

Figure 9:
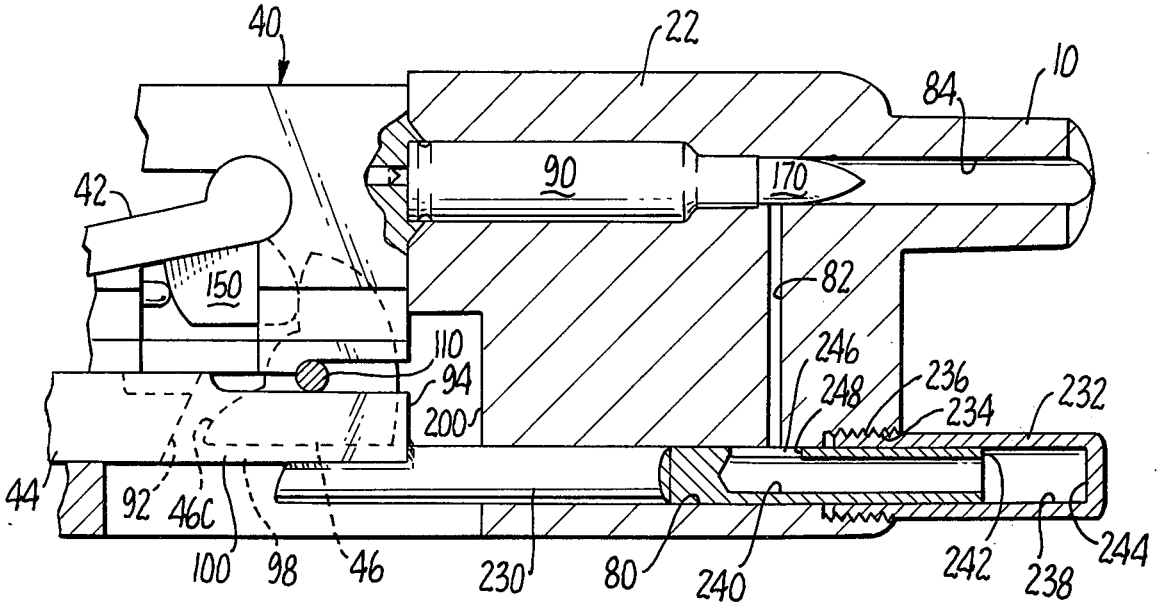
FIG. 9 is a vertical sectional view of an alternative preferred embodiment of the present invention in which the operating slide driving piston of the preferred embodiment of the present invention as shown in FIG. 7 is replaced by a sleeve valve piston which itself constitutes a major feature of the present invention.

Referring now to FIG. 9 and comparing the same with FIG. 2, it will be seen that the firearm of the alternative preferred embodiment of FIG. 9 differs structurally from the above-described preferred embodiment illustrated in FIGS. 1 through 8 by the substitution of a sleeve valve piston 230 for the solid piston 68 of FIG. 2, and by the provision of an extension cap 232 to increase the length of cylinder 80, the substitution of sleeve valve piston 230 for solid piston 68 and the corresponding provision of extension cap 232 constituting a major feature of the present invention.

Figure 10:
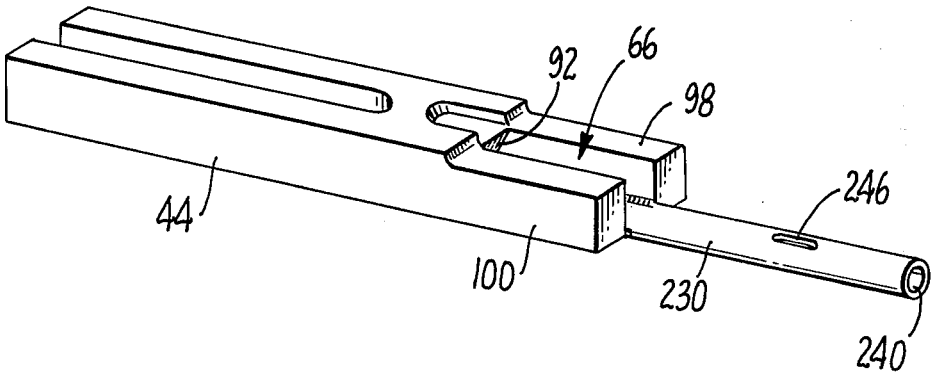
FIG. 10 is a perspective view of the operating slide of said alternative preferred embodiment.

Sleeve valve piston 230 of the alternative preferred embodiment of the present invention is also shown in FIG. 10, along with the main body of operating slide 44.

As may be seen by comparing FIGS. 9 and 10 with FIGS. 1, 1A and 2, the inner end of sleeve valve piston 230, like the inner end of solid piston 68, is affixed to operating slide 44, e.g., by brazing, or formed integrally therewith. In particular, the inner end of sleeve valve piston 230 is affixed to the lower edges of recess 66 between arms 98 and 100 of operating slide 44 as seen in FIG. 10.

As may further be seen by comparing FIG. 2 with FIG. 9, however, sleeve valve piston 30 is considerably longer than solid piston 68 of the above-described preferred embodiment. In fact, sleeve valve piston 230 is sufficiently long so that it would project through the front face of barrel block 22 in the device of the above-described preferred embodiment if threaded plug 86 were removed.

The greater length of sleeve valve piston 230 is accommodated by the provision of extension cap 232, the inner bore of extension cap 232 being substantially equal in diameter to gas cylinder 80.

Referring to FIG. 9, it will be seen that extension cap 232 is provided at its open end with threads 234, adapted to coact with the internal threads of a tapped hole 236 to form a substantially gas-tight joint between extension cap 232 and barrel block 22, and further to maintain the cylindrical inner face 238 of extension cap 232 in precise alignment with the cylindrical inner face of cylinder 80.

As may also be seen in FIG. 9, sleeve valve piston 230 is provided with an open-ended bore 240 having a depth such as to reach approximately to the position corresponding to the outer end of solid piston 68 of the above-described preferred embodiment.

It should also be noted in FIG. 9 that the longitudinal dimension of extension cap 232, and consequently the depth of bore 238, is such that even when operating slide 44 is in its forwardmost position, with forward face 94 of operating slide 44 in contact with the opposed face 200 of barrel block 22, the outer end 242 of sleeve valve piston 230 preferably does not contact the bottom 244 of bore 238.

Comparing FIGS. 9 and 10, it will be seen that an elongated port 246 extends completely through the bore wall of sleeve valve piston 230. Comparing FIG. 9 with FIG. 10, it will be realized that port 246 is in registration with the afore-described gas conduit 82 when sleeve valve piston 230 is in its quiescent condition (e.g., that shown in FIG. 9), and thus port 246 is arranged to admit operating gas under pressure from conduit 82 to the interior of bore 240, and thus to the interior of extension cap 232, when sleeve valve piston 230 is in its quiescent position.

It will also be evident to those having ordinary skill in the art, as informed by the present disclosure, and particularly FIG. 10, that sleeve valve piston 230 is prevented from rotating about its longitudinal axis, and port 246 is maintained in longitudinal alignment with gas conduit 82, due to the fact that sleeve valve piston 230 is irrotatably affixed to the main body of operating slide 44, and, as explained hereinabove, operating slide 44 is itself constrained for linear movement longitudinally of receiver 12.

In addition, it will be seen from FIG. 9 that bore 240 is sufficiently deep, and port 246 is so located and of such length, that gas-passing communication is maintained between conduit 82 and bore 240 via port 246 even when operating slide 44 is sufficiently far forward so that its cam face 92 contacts face 46C of operating cam 46.

OPERATION OF ALTERNATIVE PREFERRED EMBODIMENT

The operation of the alternative preferred embodiment is identical to the operation of the preferred embodiment first above described, except as follows:

Assuming that cartridge 90 has just been fired, operating gas under pressure will, in the well-known manner, fill barrel bore 84 behind bullet 170. Going to FIG. 9, it will be seen that that portion of the operating gas under pressure which passes down gas conduit 82 will pass through port 246, and thence into bore 240 of sleeve valve piston 230 and through the open end of bore 40 into the closed volume defined by bore 238. As in the first described preferred embodiment, the operating piston (in this case 230) and operating slide 44 will be driven toward the rear of the firearm by the operating gas under pressure.

In the alternative preferred embodiment, sleeve valve piston 230 and operating slide 44 will continue to be thus driven to the rear of the arm until the forward lip 248 of port 246 passes over the lower open end of gas conduit 82. Thereafter, while operating slide 44 continues its rearward travel due to the impulse previously imparted by the operating gas under pressure, the lower open end of gas conduit 82 will be substantially closed by the opposed wall of tight-fitting sleeve valve piston 230. This being so, the backward gas pressure exerted upon piston 230 will drop very rapidly, thereby reducing the impact or hammering effect of operating slide 44 against back block 24 of receiver 12 as compared with the same impact or hammering effect occurring in the above-described preferred embodiment.

As will be clear to those having ordinary skill in the firearms art, as informed by the present specification and drawings, the valving effect of sleeve valve piston 230 and its port 246 also serves to reduce the back pressure against which springs 72 and 74 (FIG. 1) must operate in driving operating slide 44 forward, as hereinabove discribed, thus permitting the use of lighter operating slide return springs 72, 74, and conducing to smooth, trouble-free operation of the firearm of the present invention.

Thus, it will be seen that the mechanism of the above-described preferred embodiment of the present invention serves to provide gas-operated semi-automatic fire while avoiding the jamming problems sometimes occasioned in gas-operated semiautomatic firearms due to ballooning of the spent cartridge case which occurs when the bolt is prematurely unlocked, while the pressure of the operating gas in the cartridge chamber remains high.

It will thus be seen that the objects set forth above, among those made apparent from the preceding description, are efficiently attained, and, since certain changes may be made in the above construction without departing from the scope of the invention, it is intended that all matter contained in the above description or shown in the accompanying drawings shall be interpreted as illustrative only, and not in a limiting sense.

It is also to be understood that the following claims are intended to cover all of the generic and specific features of the invention hereindescribed, and all statements of the scope of the invention which, as a matter of language, might be said to fall therebetween.

Having described my invention, what I now claim as new and desire to secure by Letters Patent is:

1. A firearm, comprising: a receiver defining a cartridge-receiving chamber, said chamber having an open breech; a bolt for closing said breech; guide ways for carrying said bolt;

a driving spring for driving said bolt along said guide ways to close said breach;

a locking member pivotally mounted in said bolt;

recesses in said guide ways for receiving said locking member to lock said bolt in its breech-closing position;

an operating slide slidably mounted in said receiver for sliding parallel to said bolt;

a gas piston for driving said operating slide rearwardly in said receiver from its pre-firing position whenever a cartridge is detonated in said chamber;

return springs for driving said operating slide forwardly in said receiver past said pre-firing position;

a cam pivotally mounted in said receiver for driving said locking member from said recess when rotated in a first direction by said operating slide; and a sliding member slidably mounted in said bolt and positioned to be driven into said bolt by said receiver when said bolt closely approaches said receiver, said sliding member bearing against a surface of said locking member and driving said locking member into its bolt-locking state whenever said locking member is driven into said bolt.

2. A firearm as claimed in claim 1, further comprising a spring for resiliently biasing said locking member into its bolt-locking position.

* * * * *